US006109251A

United States Patent [19]

Häberlein et al.

[11] Patent Number: 6,109,251

[45] Date of Patent: Aug. 29, 2000

[54] RECIPROCATING PISTON ENGINE

[75] Inventors: Jürgen Häberlein, Murrhardt; Georg Becker, Schwaikheim, both of Germany

[73] Assignee: Andreas Stihl AG & Co., Waiblingen, Germany

[21] Appl. No.: 09/358,477

[22] Filed: Jul. 21, 1999

[30] Foreign Application Priority Data

Jul. 30, 1998 [DE] Germany ..... 198 34 380

[51] Int. Cl.[7] ..... F01M 13/04

[52] U.S. Cl. ..... 123/572; 123/41.86

[58] Field of Search ..... 123/572, 573, 123/574, 41.86

[56] References Cited

U.S. PATENT DOCUMENTS 2,738,779 3/1956 Christianson et al. ..... 123/41.86
3,834,156 9/1974 Cutler et al. ..... 123/572
4,969,422 11/1990 Ishikawa et al. ..... 123/41.86
5,690,084 11/1997 Gunji et al. ..... 123/572

*Primary Examiner*—Marguerite McMahon
*Attorney, Agent, or Firm*—Walter Ottesen

[57] ABSTRACT

The invention relates to a reciprocating piston engine having a piston which moves upwardly and downwardly and which rotatably drives a crankshaft and components connected therewith via a connecting rod. The crankshaft is journalled in the crankcase which has a crankcase venting system to compensate pressure in the interior space of the crankcase. The venting system includes a venting line leading away from the interior space of the crankcase. The venting line is configured as a channel in a rotating component in order to achieve a functionally reliable pressure compensation with high separating action. The channel defines a connection between the interior space of the crankcase and the atmosphere. A valve is mounted in this channel and this valve becomes unblocked under the action of centrifugal force and seals the crankcase with respect to fluids when the engine is at standstill.

18 Claims, 3 Drawing Sheets

RECIPROCATING PISTON ENGINE

FIELD OF THE INVENTION

The invention relates to a reciprocating piston engine having a piston guided so as to be longitudinally movable in a cylinder. The piston rotationally drives additional components via a connecting rod and a crankshaft. The connecting rod is journalled in a crankcase having a crankcase vent to compensate pressure in the crankcase interior space and the venting includes a venting line leading from the interior space of the crankcase.

BACKGROUND OF THE INVENTION

In reciprocating piston engines of this kind and especially for separately-lubricated four-stroke engines or the like, it is necessary to ensure for the functionally reliable operation thereof that no impermissible overpressure builds up in the crankcase interior space. It is therefore known to provide the crankcase with a compensating system via which the crankcase overpressure can be reduced, for example, into the atmosphere. An oil mist develops in the crankcase so that corresponding measures must be taken to ensure that the oil does not escape uncontrollably but is held back in the crankcase. For this purpose, complex separating elements are provided which, however, do not always guarantee the desired operation. Furthermore, it has been noted that oil escapes through the pressure compensating system when the crankcase is not in the upright position in the case of portable engines at standstill such as small engines in portable apparatus.

SUMMARY OF THE INVENTION

It is an object of the invention to provide a crankcase venting system for reciprocating internal combustion engines and especially an internal combustion engine having separate lubrication. The crankcase venting system ensures retaining the oil with the presence of a high separation effect while ensuring a reliable venting of the crankcase.

The reciprocating piston engine of the invention includes: a cylinder defining a longitudinal axis; a piston guided to move longitudinally in the cylinder; a crankcase connected to the cylinder and defining an interior space wherein pressure can develop during operation of the engine; a crankshaft assembly rotatably journalled in the crankcase and defining a rotational axis; a connecting rod operatively connected to the crankshaft assembly; the piston being connected to the connecting rod for imparting rotational movement to the crankshaft assembly; the crankshaft assembly including a component which rotates therewith and is subjected to centrifugal force during the rotation; and, a crankcase venting system including: a channel formed in the component leading from the interior space to vent the interior space to a location external of the interior space; and, a shutoff device arranged in the channel and being transferable between a first state wherein the channel is closed to the location and a second state wherein the shutoff device responds to the centrifugal force during the rotation and clears the channel to the location.

The venting line is formed in a rotating component and this venting line provides the direct connection between the interior space of the crankcase and a further space. For this reason, the flow conducting channels are subjected to the rotation. The occurring centrifugal forces can be utilized in order to separate oil, fuel mist and the like from the air to be conducted away. A reliable separation is ensured for the occurring rpms of the engine which are, for example, in the range of 2,000 to 15,000 rpm. A shutoff device in the venting line is released under the action of centrifugal forces during the rotation of the component. At standstill of the engine, the shutoff device is in the closed position whereby the crankcase is sealed with respect to fluids and no oil can escape. When the reciprocating engine is started, the venting line is cleared at specific rpms and corresponding centrifugal forces. The centrifugal-force controlled shutoff device unblocks the venting line during operation of the engine independently of the position thereof.

The venting line is preferably configured as a central bore in the rotating component and has a radial segment in which the shutoff device is advantageously mounted.

The shutoff device includes a closure member which can be lifted off its valve seat by the centrifugal forces occurring during operation by increasing the spacing to the rotational axis. In a preferred embodiment of the invention, a return spring acts on the end of the closure member lying opposite the valve seat. During standstill or at low rpms, the return spring presses the closure member against the valve seat and blocks the venting line. The rpm of the reciprocating engine at which the shutoff device opens as a consequence of the centrifugal force can be adjusted by a suitable selection of the spring hardness and the return force of the spring associated therewith.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
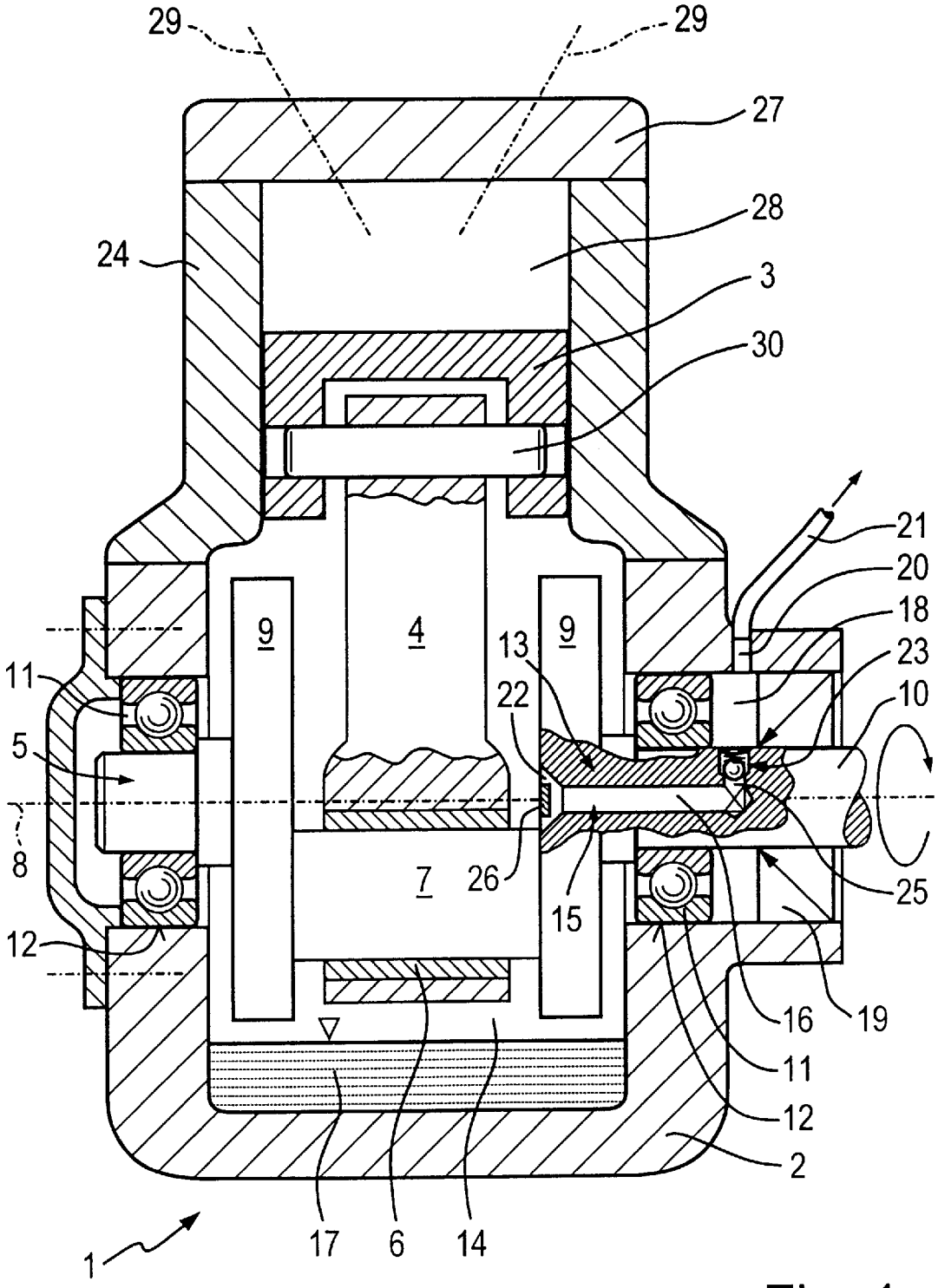
FIG. 1 is a side elevation view, in section, of a reciprocating internal combustion engine according to an embodiment of the invention.

FIG. 1 shows a section view of an engine 1 of the reciprocating type having a cylinder 24 in which a piston 3 is guided for longitudinal movement. The piston 3 delimits a combustion chamber 28. The combustion chamber 28 is closed by a cylinder head 27 in the cylinder 24 in a manner known per se. The two reference numerals 29 identify the inlet and outlet valves of the engine indicated by respective axes. The piston 3 is pivotally journalled on a connecting rod 4 by means of a piston pin 30 and drives a crankshaft 5 to rotate via the connecting rod 4 in the manner of a crank drive with its upward and downward longitudinal movement. For this purpose, the connecting rod 4 is pivotally-movably held on a crank pin 7 via a connecting rod bearing 6. The crank pin 7 is eccentrically mounted to the longitudinal center axis 8 of the crankshaft 5 between two crank webs 9. The sections 10 of the crankshaft 5 are held in crankshaft bearings 11 at respective sides of the crank webs 9. The crankshaft bearings 11 are seated in coaxially opposite lying bearing bores 12 of a crankcase 2. The crankshaft bearings 11 are roller bearings in the embodiment shown.

The crankcase 2 contains lubricating oil 17 which is sprayed in the interior space 14 of the crankcase 2 during operation of the engine by the rapidly moving parts. A crankcase venting system 13 is provided to compensate the pressure in the crankcase 2. The crankcase venting system 13 includes a venting line 15 which leads from the interior space 14 to the outside. The venting line 15 is configured as a flow channel (16, 25) in a rotating component which, in the embodiment shown, is the crankshaft 5 and provides a connection between the interior space 14 and an additional space 18 which is vented into the atmosphere and preferably into the intake system of the engine 1.

The additional space 18 is formed as a pressure compensating space between the crankshaft bearing 11 and an outer crankshaft seal 19. The crankshaft bearing 11 separates the pressure compensating space 18 from the interior space 14 of the crankcase. The pressure compensating space 18 is delimited to the outside by the crankshaft seal 19 which, for example, can be a radial shaft seal and ensures an oil tight and gas tight seal. The crankshaft 5 passes through the pressure compensating space 18 and the space 18 is configured as an annular space. A discharge line 21 is connected to the pressure compensating space 18 via an opening 20 in the crankcase 2. The discharge line 21 opens into the intake system of the engine 1 or into the atmosphere at a suitable location.

The venting line 15 in the crankshaft 5 comprises an axial bore 16 and a radial segment 25. The radial segment 25 opens into the pressure compensating space 18 and is therefore arranged at the corresponding axial location of the crankshaft 5. The inlet of the axial bore 16 on the end face of the crank web 9, which faces toward the connecting rod 4, is in the form of a funnel 22. The funnel 22 lies on the crankshaft 5 rotationally symmetrically to the rotational axis and extends into the central axial bore 16 at the tapered end thereof. The funnel 22 impedes the oil mist, which is in the crankcase 2, from entry into the crankcase venting system 13. The inlet of the venting line can also be covered by a material permeable to air. The fine oil mist, which is entrained by the compensating air, separates as droplets in the weave of the fabric, non-woven fabric or the like and, because of the rotation, the droplets are mechanically separated under the action of the rotational force and are returned into the crankcase 2.

In the embodiment shown, a baffle plate 26 is mounted in the inflow funnel 22 and extends transversely to the funnel opening. An annular gap is defined by the outer edge of the baffle plate 26 and the wall of the funnel 22. The baffle plate 26 increases the separating action in the inlet region of the crankcase venting system 13 and can be made of an air-permeable material.

Figure 3:
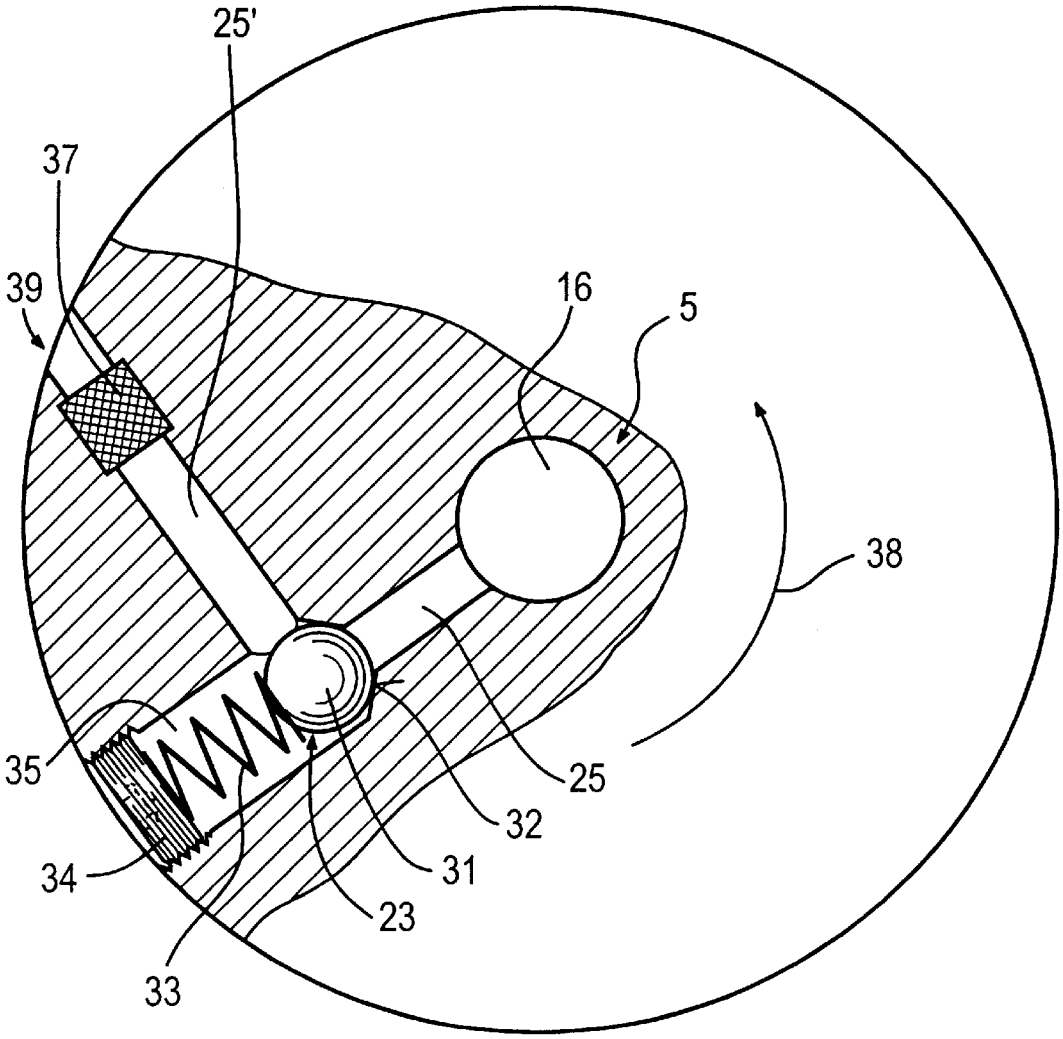

A blocking or check valve 23 is mounted in the radial segment 25 of the venting line 15. The check valve opens under the action of centrifugal force during the rotation of the crankshaft 5. An embodiment of such a venting valve 23 is shown in FIG. 3. The venting valve 23 is mounted in a radial bore 25 lying radially to the rotational axis 40 and includes a valve ball 31 as a movable closure element. The valve ball 31 has a greater diameter than the radial bore 25 and the cross-sectional expansion of the radial bore 25 defines a valve seat 32 on which the valve ball 31 lies. The valve ball 31 is longitudinally movable in a valve chamber 35. The valve chamber 35 coaxially extends from a first radial segment of the radial bore 25. The valve ball 31 is pressed by a return spring 33 against the valve seat 32. A connecting line 25' of the radial segment branches from the valve chamber 35 next to the valve seat 32. This connecting line 25' penetrates the surface of the crankshaft 5 and defines the venting connection. The return spring 33 acts on the end of the closure ball 31 which lies diametrically opposite the valve seat 32 and is supported axially on a closure plug 34 of the valve chamber 35.

During operation of the engine, centrifugal forces act on the mass-subjected valve ball 31 because of the rotational movement of the crankshaft 5. The return force of the spring 33 is overcome when a specific rpm and the centrifugal force occurring therewith are reached. The ball 31 lifts from the valve seat 32 to clear the valve 23. The restoring force of the spring is so selected that the venting line (axial bore 16/radial bore 25, 25') is unblocked in large rpm regions and, in this way, venting of the crankcase is ensured. At standstill of the engine, the return spring 23 presses the valve ball 31 onto the valve seat 32 and thereby automatically closes the venting valve 23. A gas discharge or oil discharge from the crankcase through the valve line is thereby precluded.

The opening time point of the venting valve can be assigned to a specific rpm of the engine by a suitable selection of the spring length and spring hardness of the return spring 33. The control rpm of the centrifugal-force controlled venting valve 23 can, in the embodiment shown, also be varied via the change of the depth to which the closure plug 34 is screwed into the valve chamber 35. The closure plug 34 is held in the wall of the valve chamber 35 in the manner of a screw by means of a thread and, by rotating the closure plug 34 deeper, the pretensioning force of the return spring 33 is increased.

Figure 2:
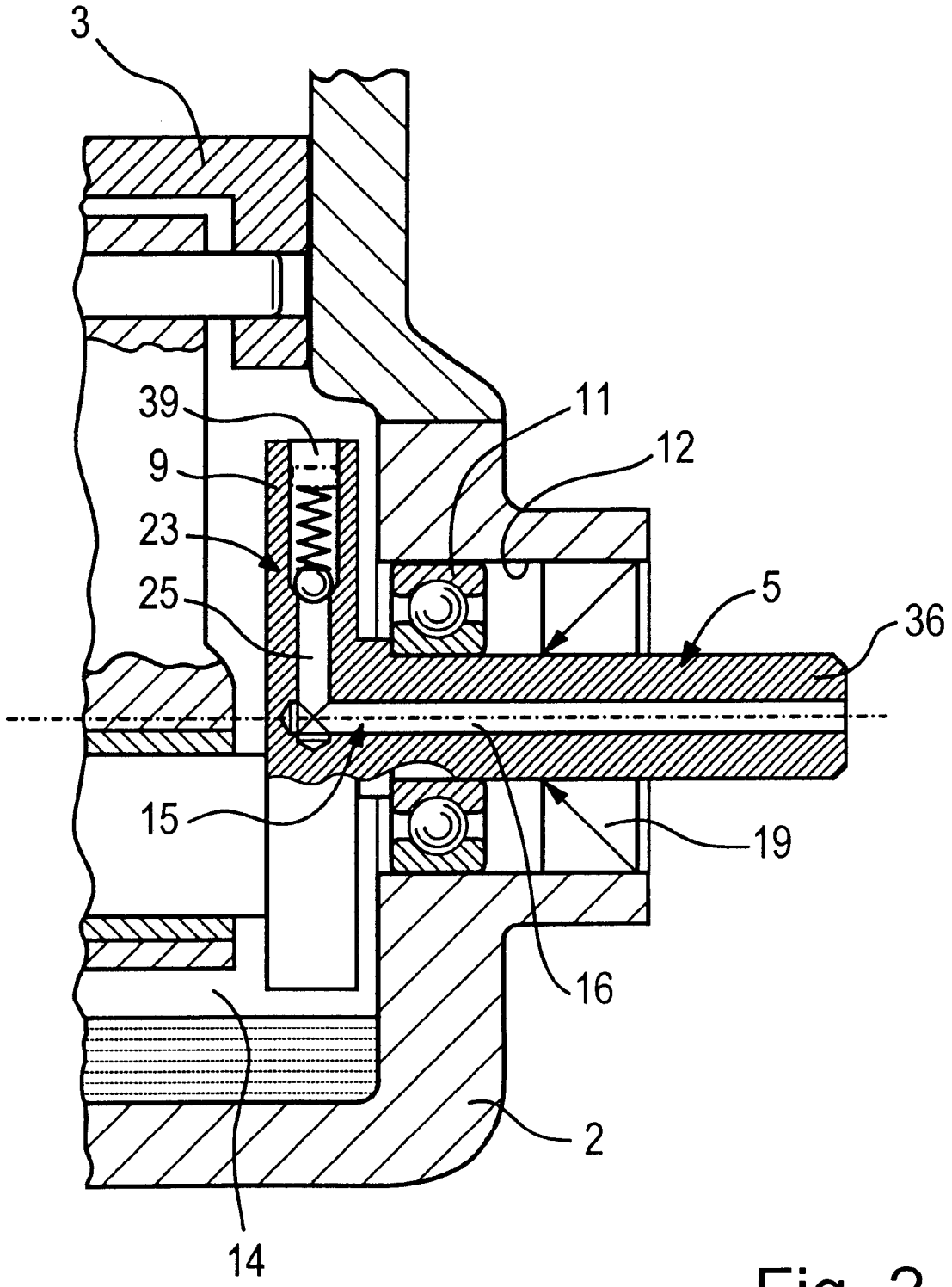
FIG. 2 is a detail view, in section, of a portion of a reciprocating internal combustion engine showing the component thereof containing the crankcase venting system; and, FIG. 3 is a cross section of the rotating component of the engine containing the venting line at the location of the venting valve.

FIG. 2 is a detail view, in longitudinal section, of an engine having a configuration corresponding essentially to the engine shown in FIG. 1. The operation of the crank drive, which converts the longitudinal movement of the piston 3 into a rotational movement of the crankshaft 5, is already described with respect to FIG. 1. The components of FIG. 2 which correspond to those of FIG. 1 are provided with the same reference numerals.

The axial bore 16 extends from the radial segment 25 in the through-flow direction of the venting line 15. The radial segment 25 is formed in the crank web 9 of the crank drive and contains a centrifugal force controlled venting valve 23. An entrance 39 into the venting line is formed by the breakthrough of the radial segment 25 at the periphery of the crank web 9. The axial bore 16 of the venting line 19 passes through the exposed end 36 of the crankshaft 5 and defines the venting connection of the crankcase interior space 14 into the atmosphere. However, a connecting line into the intake system of the engine can be connected to the outlet of the axial bore 16 at the end face of the shaft end 36.

The radial section 25 of the venting line 15 can also be formed in the crankshaft 5 itself or in other rotating components whereby the venting valve 23 is subjected to the action of the centrifugal force of the rotating component. In an especially advantageous manner, the radial segment can be mounted in a cam wheel for controlling the gas-exchange valves of the engine. The cam wheel is mounted within the crankcase 2.

FIG. 3 shows a configuration of the venting line with an axial bore 16 between the venting valve 23 and the inlet 39 of the venting bore. The axial bore 16 extends from the radial segment. In this configuration, a filter 37 is mounted at the periphery of the rotating component 5. The filter 37 increases the separating action of the venting system and holds the oil mist back in the crankcase. The filter 37 can be advantageously made of a fabric. The oil droplets, which are formed on filter 37, are thrown back into the crankcase by the centrifugal force of the rotating component 5.

The connecting line 25' between the radial bore 25 and the surroundings of the rotating component branches from the valve seat 32 of the venting valve 23 in a direction opposite to the rotational direction 38. The connecting line 25' with the inlet 39 of the venting line runs behind the radial bore 25 and the venting valve 23 in the rotational direction 38 whereby the deposit of the oil mist from the venting line is improved. An exiting of oil from the crankcase is substantially precluded with this configuration at full pressure compensation of the crankcase interior space.

The separately lubricated engine can be used especially in portable handheld work apparatus such as motor-driven chain saws and the like. If such work apparatus are put down at standstill in a non-upright position of the engine, then the exit of any fluid from the interior space of the crankcase through the venting line is prevented.

It is understood that the foregoing description is that of the preferred embodiments of the invention and that various changes and modifications may be made thereto without departing from the spirit and scope of the invention as defined in the appended claims.

What is claimed is:

1. A reciprocating piston engine comprising:

a cylinder defining a longitudinal axis;

a piston guided to move longitudinally in said cylinder;

a crankcase connected to said cylinder and defining an interior space wherein pressure can develop during operation of said engine;

a crankshaft assembly rotatably journalled in said crankcase and defining a rotational axis;

a connecting rod operatively connected to said crankshaft assembly;

said piston being connected to said connecting rod for imparting rotational movement to said crankshaft assembly;

said crankshaft assembly including a component which rotates therewith and is subjected to centrifugal force during the rotation; and, a crankcase venting system including: a channel formed in said component leading from said interior space to vent said interior space to a location external of said interior space; and, a shutoff device arranged in said channel and being transferable between a first state wherein said channel is closed to said location and a second state wherein said shut-off device responds to said centrifugal force during said rotation and clears said channel to said location.

2. The reciprocating piston engine of claim 1, wherein said location is an ancillary space external to said interior space of said crankcase; and, said channel interconnects said interior space and said ancillary space.

3. The reciprocating piston engine of claim 2, said channel including first and second segments in said component; said first segment being an essentially axial bore in said component and said second segment being a radial segment extending from said axial bore and communicating with said ancillary space when said shutoff device is in said second state.

4. The reciprocating piston engine of claim 3, wherein said axial bore lies near said rotational axis.

5. The reciprocating piston engine of claim 3, wherein said axial bore lies on said rotational axis.

6. The reciprocating piston engine of claim 3, said second segment being a radial bore; and, said shutoff device including a valve seat formed in said radial bore; and, a closure element which can lift from said valve seat by increasing the distance of said closure element from said rotational axis.

7. The reciprocating piston engine of claim 6, said closure element having a first end facing toward said valve seat and a second end facing away from said valve seat; and, said shutoff device further including a return spring acting on said second end of said closure element.

8. The reciprocating piston engine of claim 7, wherein said closure element is spherically shaped.

9. The reciprocating piston engine of claim 7, said shutoff device further including a valve chamber formed in said component for accommodating said closure element; and, said return spring being mounted in said valve chamber radially to said rotational axis.

10. The reciprocating piston engine of claim 1, wherein said engine is configured as a separately lubricated internal combustion engine.

11. The reciprocating piston engine of claim 3, said crankcase venting system further including an entry into said radial segment.

12. The reciprocating piston engine of claim 11, said crankcase venting system further including a filter disposed between said entry and said shutoff device.

13. The reciprocating piston engine of claim 1, wherein said channel has a funnel-shaped inlet opening into said interior space.

14. The reciprocating piston engine of claim 13, wherein said crankcase venting system further includes a material permeable to air covering said funnel-shaped inlet.

15. The reciprocating piston engine of claim 14, wherein said material is a fabric or non-woven fabric.

16. The reciprocating piston engine of claim 13, wherein said crankcase venting system further includes a baffle plate mounted in front of said funnel-shaped inlet so as to extend transversely to said rotational axis.

17. The reciprocating piston engine of claim 16, wherein said baffle plate has an outer edge and said funnel-shaped inlet has a wall surface; and, said outer edge and said wall surface conjointly defining an annular gap.

18. The reciprocating piston engine of claim 17, wherein said baffle plate is made of an air permeable material.

* * * * *